United States Patent [19]

Fricke et al.

[11] Patent Number: 4,514,609

[45] Date of Patent: Apr. 30, 1985

[54] PUSHBUTTON SWITCH HAVING LEAF-SHAPED CONTACT SPRING

[75] Inventors: Reinhard L. Fricke; Klaus Hinze; Manfred K. O. Huth; Klaus B. Wisskirchen, all of Berlin, Fed. Rep. of Germany

[73] Assignee: ITT Industries, Inc., New York, N.Y.

[21] Appl. No.: 425,393

[22] Filed: Sep. 28, 1982

[30] Foreign Application Priority Data

Oct. 9, 1981 [DE] Fed. Rep. of Germany ..... 3140199

[51] Int. Cl.[3] ..... H01H 3/12; H01H 1/18

[52] U.S. Cl. ..... 200/159 A; 200/241; 200/76

[58] Field of Search ..... 200/76, 67 R, 67 A, 200/67 E, 67 DA, 159 A, 283, 281, 241, 242, 243, 5 A, 340

[56] References Cited

U.S. PATENT DOCUMENTS

| | | | |
|---|---|---|---|
| 2,661,408 | 12/1953 | Shabeck, Jr. | 200/76 |
| 3,164,708 | 1/1965 | Theobald | 200/283 X |
| 3,196,230 | 7/1965 | Barden et al. | 200/76 |
| 3,319,022 | 5/1967 | Froyd et al. | 200/241 X |
| 3,624,332 | 11/1971 | Van Benschoten | 200/241 X |
| 3,668,347 | 6/1972 | Korsgren | 200/76 |
| 3,736,395 | 5/1973 | Miller | 200/159 A |
| 3,902,032 | 8/1975 | Koepke | 200/159 A X |
| 4,006,322 | 2/1977 | Gallatin et al. | 200/16 A |
| 4,188,518 | 2/1980 | du Temple de Rougemont | 200/241 X |
| 4,260,862 | 4/1981 | Orcutt | 200/283 X |

FOREIGN PATENT DOCUMENTS

| | | |
|---|---|---|
| 1003318 | 2/1951 | Fed. Rep. of Germany . |
| 7220520 | 5/1972 | Fed. Rep. of Germany . |
| 2942720 | 5/1981 | Fed. Rep. of Germany . |

*Primary Examiner*—Stephen Marcus
*Assistant Examiner*—Ernest G. Cusick
*Attorney, Agent, or Firm*—James B. Raden; William J. Michals

[57] ABSTRACT

A pushbutton switch is provided comprising a leaf spring with slotted leaf ends for forming a double contact and a fixed contact arranged transversely in relation thereto. The slotted spring ends, in the direction of the leaf spring axis, are provided with groove-shaped stampings. This results in a point-shaped contact which migrates as a result of the bending of the leaf spring so that a high contact pressure is produced and a self-cleaning of the contacts is achieved.

1 Claim, 12 Drawing Figures

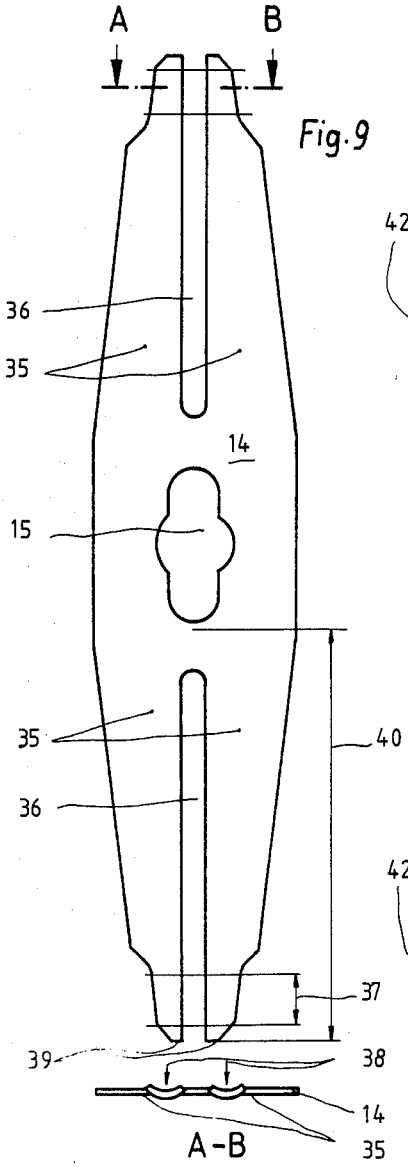
Fig.9
Fig.10
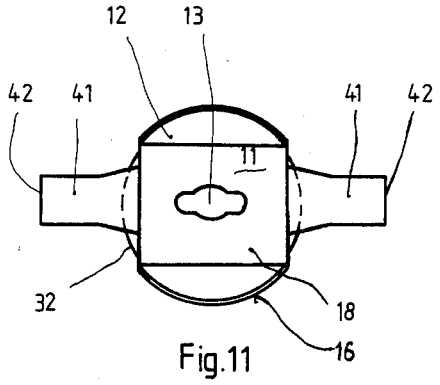
Fig.11
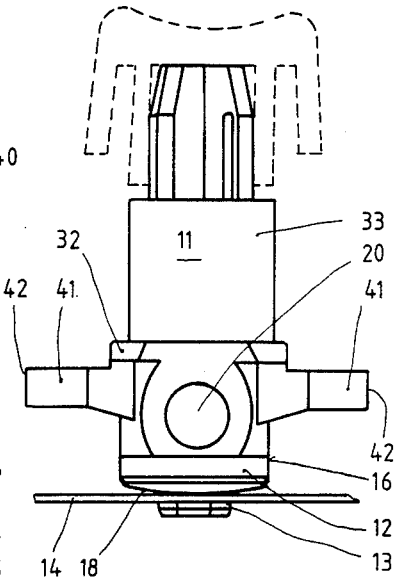
Fig.12

PUSHBUTTON SWITCH HAVING LEAF-SHAPED CONTACT SPRING

The present invention relates to a pushbutton switch, particularly to a key switch, comprising a switch plunger capable of being displaced in the axial direction in opposition to the force of a compression or snap-action spring, whose end carries a contact spring with contact arms standing off on both sides, with the contact arms at least within the end part, by being slotted in the longitudinal direction, being designed as dual contacts which are capable of co-operating with fixed contacts having a roller-like rounded contact path, arranged vertically in relation to the slot direction and, at least within the contact-making area, consist of a flat material.

One such pushbutton (key) switch is known, for example, from the applicant's earlier DE-OS No. 2 942 720 (W. Rösl-21). In this conventional type of pushbutton switch, the contact spring is designed as a flat spring extending in one plane, and the contact surfaces are likewise of a plane design. When completely applied, this results in a large-area contact at the contact-making point. This, however, effects a relatively small contact pressure which, especially in the case of pushbutton switches which are only supposed to have a small pushbutton pressure, is considered disadvantageous. If the contact spring or the fixed contact, or both, however, for some reason or other, are not exactly assembled in the same plane, the edge of the contact spring is positively connected to the contact path, with this resulting in a rather high contact pressure and, therefore, in a very considerable wear, because the edges are sharp.

Moreover, from DE-AS No. 1 003 318 it is already known with respect to a slide switch for very high actuating forces, serving as a limit switch, to rivet contact rivets to the ends of the contact spring. In this switch, the stationary opposite contacts are circularly arched inwardly, so that during the pressing and bending of the contact spring, the contact rivets are capable of sliding frictionally on the circular contact path. This is supposed to result in a self-cleaning of the contacts during operation.

Furthermore, from the German Utility Model DE-GM No. 7 220 520, it is already known to design the contact areas of an isolating switch for use in telecommunication systems, in such a way by crossing beads that a point-shaped contact results. By this it is intended to achieve a high contact pressure.

It is the object of the invention to achieve, with respect to a pushbutton switch for a low pushbutton pressure, a self-cleaning, as well as to enable a high contact pressure.

According to the invention, this object is achieved in that the switch plunger, following the effected contact making and still in the overtravel, is capable of being actuated to such an extent that the ends of the contact arms, in the manner known per se, are capable of deflecting by 10 to 35% of their free arm lengths, and that the ends are embossed in such a way and extending in the slot direction, that the surface thereof facing the fixed contact, is convexly arched over the entire angle of contact enforced by the overtravel, that per contact arm and throughout the entire contact angle there are respectively formed two points of contact. Accordingly, in this way the advantages achievable by the slide switch of high actuating force as well as those resulting from the isolating switch for telecommunication systems in which no friction occurs, are combined in a switch having a low pushbutton pressure.

Further advantageous details of the invention will now be described hereinafter with reference to an example of embodiment shown in FIGS. 1 to 10 of the accompanying drawings, in which.

Figure 1:
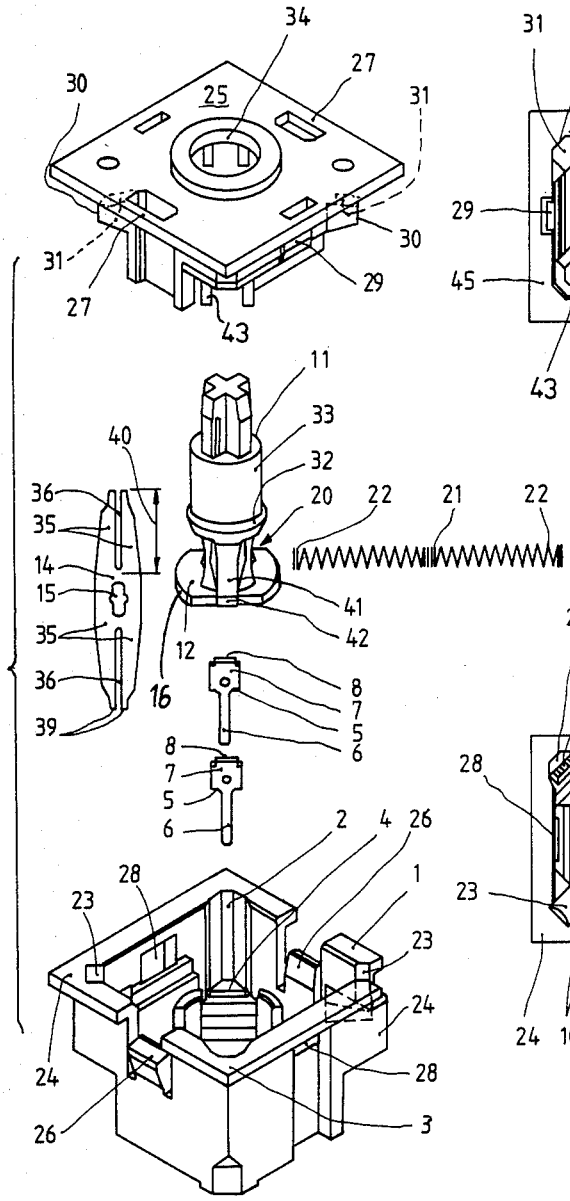
FIG. 1 is the exploded view of the switch according to the invention.
Figure 2:
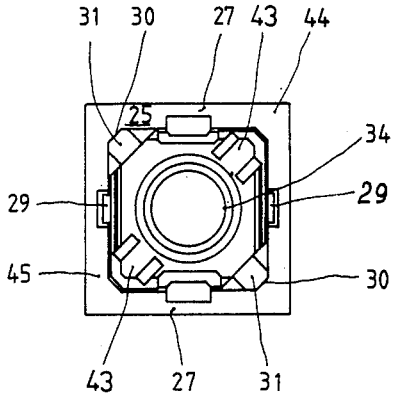
FIG. 2 shows the employed switch plunger from below.
Figure 3:
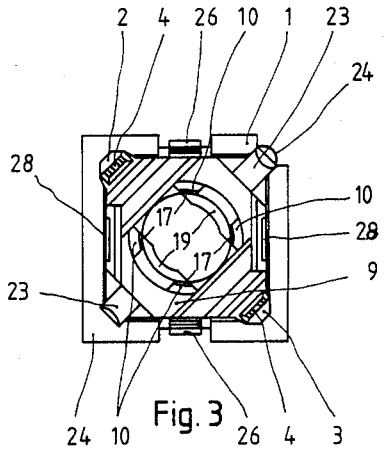
FIG. 3 shows the switch plunger in a side view.
Figure 4:
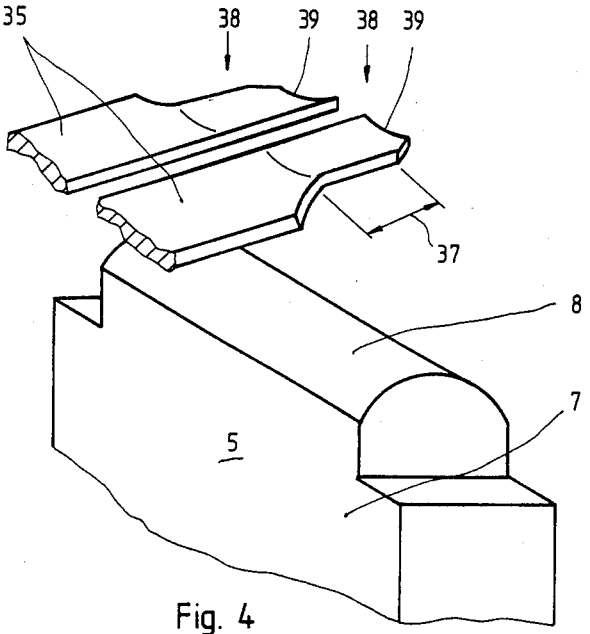
FIG. 4 shows part of the contacts of the switch on an enlarged scale.
Figure 5:
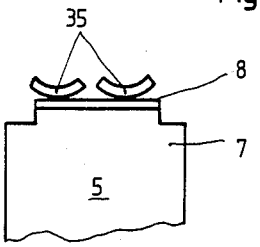
Figure 6:
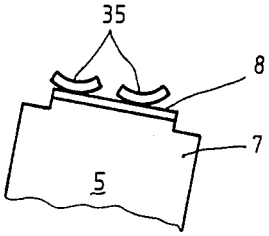
Figure 7:
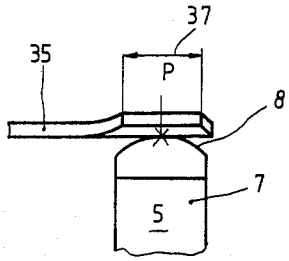
Figure 8:
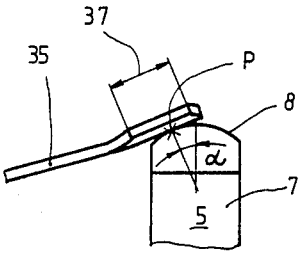

FIGS. 5 and 6 show the dual contact when looked at in the direction of the flat spring, FIGS. 7 and 8 show the contact according to FIGS. 5 and 6 in a view staggered by 90 degrees, FIG. 9 shows the flat spring in a top view, and FIG. 10 is a sectional view of the contact spring taken on the line A—B of FIG. 9.

FIG. 11 shows a bottom view of the switch plunger with the extension for the leaf spring contact, FIG. 12 shows a second embodiment of the invention with the plunger removed from the casing.

The reference numeral 1 indicates a cup-shaped and in the top view preferably square-shaped casing moulded from, for example, an elastically deformable insulating material. At its diagonally oppositely arranged corners 2 and 3 there are provided plug-in slots 4 arranged vertically in relation to the diagonal line, in which one fixed contact 5 each is capable of being plugged by means of its narrow tongues 6, and is capable of being fixed therein. The upper flat and widened portion 7 is provided with an upper roller-shaped, rounded contact path 8.

At the bottom 9 of the casing 1 there are arranged four webs 10 projecting vertically in the upward direction, which serve the centering, the axially displaceable and rotatable bearing of a switch plunger 11 made of a suitable plastics material. The latter has a disk-shaped lower end 12 with a downwardly projecting flap-shaped extension 13 (FIGS. 11 and 12). On to this extension 13 there is slipped a lancet-like, leaf-shaped contact spring 14 by means of a central recess 15 adapted to the cross-section of the extension 13, and is fixed in its position by way of a mechanical, plastic and/or thermoplastic deformation of the extension 13.

The outer edge 16 of the switch-plunger end 12 together with the inner surfaces 17 of the webs 10, forms a lower shaft bearing. The insertion depth of the switch plunger 11 is restricted by its supporting surface 18 and by lateral supporting means 19 at the bottom 9 of the casing 1. The latter are so designed and arranged that the extension 13 of the switch plunger 11 is prevented from touching the bottom 9, and that the contact spring 14 is capable of moving between them.

In its lower third the switch plunger 11 is provided with an opening 20 extending in the transverse direction of the contact spring 14. Through this opening, a spiral spring 21 can be pushed, with the standing-off ends 22 thereof being bent downwardly upon insertion of the switch plunger 11 into the casing 1, for engaging into grooves 23 of the casing 1. These grooves 23 are provided for in the corners 24 neighbouring the corners 2 and 3. The bottom of these grooves is inclined from the outside towards the inside and extends slantingly in the upward direction.

Following the insertion of the switch plunger 11, the housing 1 is topped by a cover 25 preferably consisting of an elastically deformable insulating material, with both parts being locked to one another with the aid of suitable snap-action elements 26, 27 and 28, 29 associated with one another. In so doing, the extensions 30 with their top parts extending from the outside towards the inside slantingly in the upward direction, press upon the ends 22 of the spiral spring 21, thus clamping the latter in the arched position. In this way there is achieved the desired snap action of the pushbutton switch or of the switch plunger 11 respectively. When at normal, the switch plunger 11 is pushed upwardly thus permitting it to meet with a collar 32 against the inside of the cover.

In the assembled state, the central shaft-shaped portion 33 of the switch plunger 11 together with a ring-shaped recess 34 in the cover 25, forms an upper bearing.

According to the invention, the contact arms 35 of the contact spring 14 as standing off on both sides from the mounting point (extension 13) are each provided with a longitudinal slot 36, so that per contact arm there is obtained a dual contact.

The contact area 37 of the contact spring 14 may be provided with a special contact layer. According to the invention, and by a stamping 38, it is provided with an arching extending in the slot direction, with the convex surface thereof, in the assembled state, lying opposite the associated fixed contact 5. In this way it is accomplished that the fixed contact 5 may also be slanting in relation to the plane of the contact spring 14 and yet preventing any sharp lateral edge thereof from pressing upon the contact path 8 (FIGS. 5 and 6).

The arrangement is made in such a way that the switch plunger 11 is capable of being actuated in the over-travel, i.e. that it, from the moment of contact making, is still capable of being further moved axially in the downward direction. The overtravel is so large that the ends 39 of the contact arms 35, owing to the bending through of the contact spring 14, are capable of being deflected by about 10 to 35% of the length of the free arm length 40 of the contact spring 14. Owing to the bending through of the contact spring 14, the point of contact P of the contact area 37 is displaced further towards the outside and, in addition thereto, the supporting point of the contact area 37 moves on the contact path 8 by the angle of contact $\alpha$. By the arching of the contact areas 37 it is accomplished that throughout the entire contact path section which is swept over by the angle of contact $\alpha$, there is achieved a point-shaped support. Accordingly, in this way there is achieved a high contact pressure and, consequently, a lower transfer resistance throughout the entire contact area and, in addition thereto, a self-cleaning of the contacts.

According to one preferred embodiment of the invention, the supporting surface 18 of the switch plunger end 12 is arched in the direction of the bending through of the contact spring 14. Preferably, the arching has at least approximately such a shape as can be assumed by the contact spring 14 during its maximum bending through. The arching radius has about 1.2 to 2 times the size of one free contact arm length 40. Preferably, the length of the supporting surface in the direction of the contact spring axis amounts to about 20 to 40% of the length of the contact spring 14.

An appropriate further embodiment of the invention shows that the bearings of the switch plunger 11 inside the casing 1 and inside the cover 25 are designed to have a circular cross-section, and that the exact angular position of the contact spring 14 is achieved by relatively long fingers 41 extending in the same, preferably radial, direction as the contact arms 35 arranged above the contact spring 14. The ends 42 thereof each slide in a vertical guide groove 43 in the casing 1 or in one of the casing parts, in particular inside the cover 25. For achieving a maximum possible length of the fingers 41, the guide grooves 43 are provided for in the corners 44, 45 of the cover 25 corresponding to the diagonally opposite corners 2, 3 of the casing 1. By this measure there is achieved a high angular accuracy by maintaining the usual manufacturing tolerances of the plastics mouldings. If, for example, the switch plunger 11 itself were to be designed to have a square shape for example, then certain minimum spacings or minimum tolerances would have to be adhered to in order to safeguard a smooth running and to avoid a tilting or twisting. When considering the small size of the switches for the use with keyboards for computers, calculators, office machines, etc, this may already result in an inadmissibly high angular distortion or twisting of the pushbutton and, above all, of the contact spring 14. If, in accordance with the invention, however, the angular fixing is carried out at a point lying radially further towards the outside, it is possible, by maintaining the same tolerance, to achieve an angular accuracy which is higher by the factor 2 to 4. By arranging the guide grooves 43 inside the cover 25, the switch construction can be kept particularly small in the travel direction. The sliding fingers 40, in addition thereto, may serve to restrict the travel of the switch plunger 11 or of the pushbutton key in the upward and/or downward direction.

We claim:

1. An electrical pushbutton switch comprising, in combination:

a casing having an axis, axially extending wall portions, a base portion and at least two radially spaced stationary contacts mounted to said base and extending axially upwardly a rod-shaped switch plunger axially movable in said casing and having a pair of arms extending in radially opposite directions from an axially intermediate portion of said plunger, said plunger including an axially inner end portion and an axially outer end portion;

a leaf spring contact mounted at a central portion thereof to the axially inner end portion of said plunger and extending outwardly in radially opposite directions therefrom for engaging said stationary contacts when said plunger is moved toward said base;

a compression spring extending through a transverse through bore in an intermediate portion of said plunger and respectively terminating in radially opposite groove portions of said wall portions of said casing, said compression spring resiliently urging said plunger away from said base; and, a cover enclosing the axially outer end portion of said casing and having a central opening for receiving said plunger and said cover having a pair of axially extending radially opposite guide grooves for receiving radially outer ends of said arms for guiding and angularly orientating said plunger.

* * * * *